US008376536B2

(12) United States Patent
Nakamura

(10) Patent No.: US 8,376,536 B2
(45) Date of Patent: Feb. 19, 2013

(54) LIQUID CARTRIDGE URGING UNITS

(75) Inventor: Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 48 days.

(21) Appl. No.: 13/051,778

(22) Filed: Mar. 18, 2011

(65) Prior Publication Data

US 2011/0310195 A1 Dec. 22, 2011

(30) Foreign Application Priority Data

Jun. 17, 2010 (JP) ..... 2010-137836

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 6,170,942 B1 * 1/2001 Ogawa et al. ..... 347/88
6,199,977 B1 * 3/2001 Komplin et al. ..... 347/86

FOREIGN PATENT DOCUMENTS

JP 2005-288866 A 10/2005

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A liquid cartridge urging unit includes a frame including at least one guide bar and two or more sliders. Each of the two or more sliders moves between a release position and a mount position. The liquid cartridge urging unit also includes two or more urging members configured to urge the two or more sliders, respectively, and at least one stopper disposed at the at least one guide bar and configured to contact the two or more sliders to restrict a movement of the two or more sliders. Each of the two or more sliders and the at least one guide bar includes an engagement portion configured to restrict movements of one of the two or more sliders and a corresponding one of the at least one guide bar separating from each other.

11 Claims, 11 Drawing Sheets

LIQUID CARTRIDGE URGING UNITS

CROSS REFERENCE TO RELATED APPLICATION

The present application claims priority to and the benefit of Japanese Patent Application No. 2010-137836, which was filed on Jun. 17, 2010, the disclosure of which is incorporated herein by reference in its entirety.

BACKGROUND OF THE INVENTION

1. Field of the Invention

The present invention relates to liquid cartridge urging units for a mounting portion to which a liquid cartridge is configured to be mounted by being moved in a first direction, and, more specifically, relates to liquid cartridge urging units configured to urge the liquid cartridge in a second direction opposite to the first direction.

2. Description of Related Art

As a printing apparatus, a known ink-jet printing apparatus is configured to form images on printing media such as a sheet of paper by ejecting ink droplets from a printhead. The ink-jet printing apparatus has an ink cartridge having ink stored therein, and is configured to eject ink supplied from the ink cartridge as ink droplets from the printhead. One type of the ink cartridge is configured to be mounted on a carriage, which reciprocates along a printing surface of the printing medium together with the printhead, and configured to supply ink directly to the printhead. Another type of the ink cartridge is configured to be mounted to a holder provided in a printing apparatus to supply ink via a tube to the printhead. The ink cartridge of either type is configured to be removed from the printing apparatus when the remaining amount of ink stored therein becomes small and be replaced with a new ink cartridge having ink filled therein.

A person to replace the ink cartridge is not limited to a person having a specific skill, but may be an end user, who actually uses the printing apparatus. Therefore, the printing apparatus may need to have a configuration which allows a user to replace the ink cartridge easily and reliably. Accordingly, a known liquid container holder is configured such that a liquid container, e.g., an ink cartridge, is mounted to and fixed in the liquid container holder by being inserted and pressed into the liquid container holder in an insertion direction. Moreover, when the liquid container is removed from the liquid container holder, the liquid container is released from the fixed state by pressing the liquid container mounted in the liquid container holder in the insertion direction, and the liquid container is pushed out in a removal direction by a spring-biased slider member. This liquid container has a flat rectangular parallelepiped shape, and the liquid container holder has a plurality of mounting portions for accommodating a plurality of liquid containers, respectively, such that the plurality of liquid containers are aligned in a direction perpendicular to the insertion direction. The plurality of mounting portions are structurally independent of each other, corresponding to the respective liquid containers.

Incidentally, liquid cartridges and mounting portions may need to be downsized to meet the trend of the downsizing of printing apparatus. However, because the mounting portions described above are structurally independently of each other, components for the mounting portions are also independently provided for respective mounting portions. Therefore, the number of components is increased, which hinders downsizing of the mounting portions.

SUMMARY OF THE INVENTION

Therefore, a need has arisen for liquid cartridge urging units which overcome these and other shortcomings of the related art. A technical advantage of the invention is that a mounting portion is downsized.

In an embodiment of the invention, a liquid cartridge urging unit for a mounting portion to which a liquid cartridge is configured to be mounted by being moved in a first direction, comprises a frame comprising two side portions extending in the first direction, wherein each of the two side portions comprises a first end in the first direction, a connecting portion connecting the first ends of the two side portions, and at least one guide bar extending from the connecting portion in a second direction opposite to the first direction and positioned between the two side portions. The liquid cartridge urging unit also comprises two or more sliders, each of which is positioned between one of the two side portions and one of the at least one guide bar which is positioned adjacent to the one of the two side portions or between two of the at least one guide bar positioned adjacent to each other, wherein each of the two or more sliders is configured to contact the liquid container positioned in the mounting portion and configured to be guided by the at least one guide bar, such that each of the two or more sliders moves between a release position and a mount position, wherein the mount position is away from the release position in the first direction. The liquid cartridge urging unit further comprises two or more urging members configured to urge the two or more sliders in the second direction, respectively, and at least one stopper disposed at the at least one guide bar and configured to contact the two or more sliders to restrict a movement of the two or more sliders in the second direction, such that the two or more sliders do not move beyond the release position. Each of the two or more sliders and the at least one guide bar comprises an engagement portion configured to restrict movements of one of the two or more sliders and a corresponding one of the at least one guide bar separating from each other in a direction perpendicular to the first direction.

Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-11B, like numerals being used for like corresponding parts in the various drawings.

Figure 1:
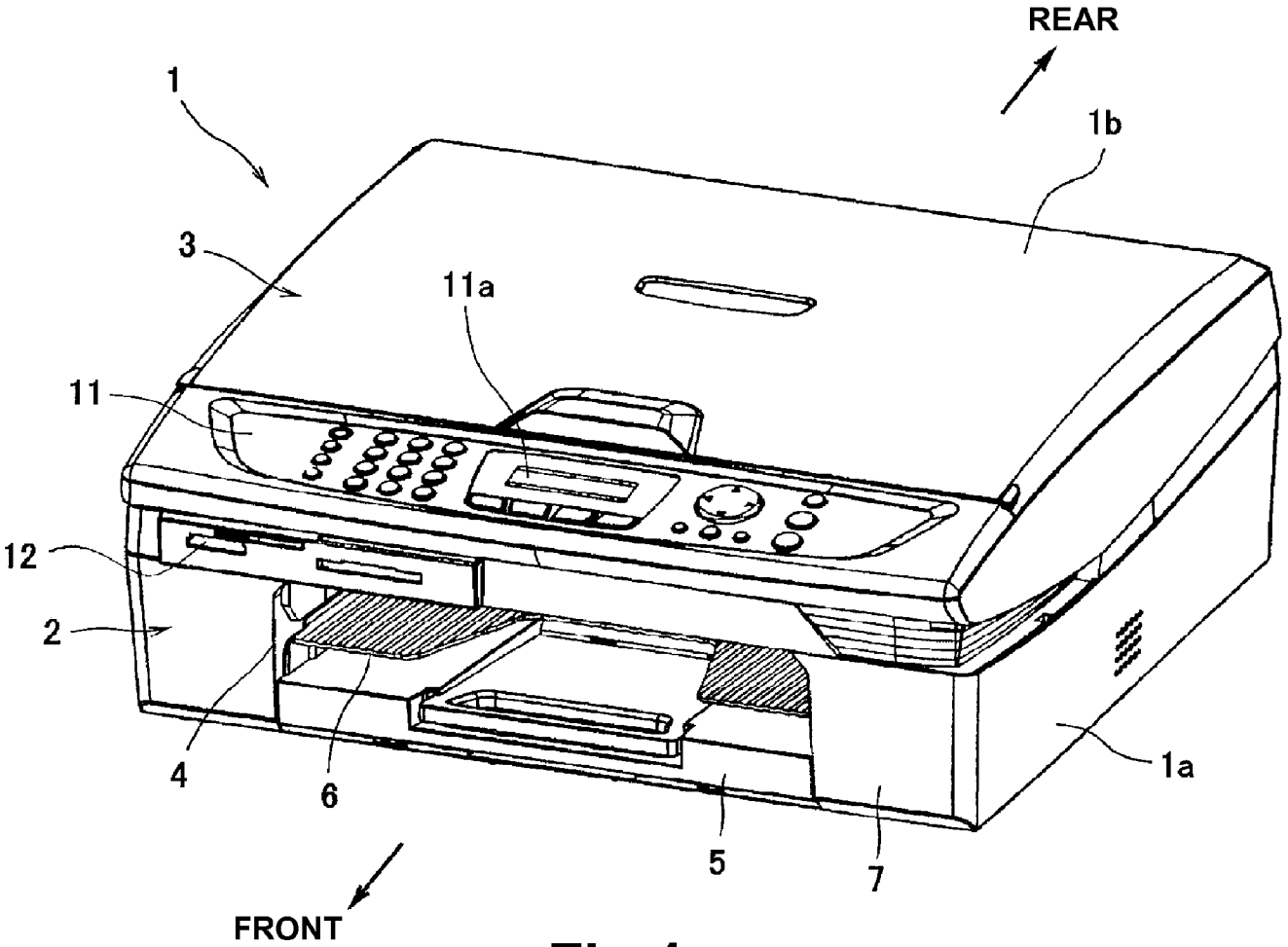
FIG. 1 is a perspective view of a printing apparatus comprising a liquid supply device according to an embodiment of the present invention.

Referring to FIG. 1, a printing apparatus 1 comprises a housing 1*a* of a substantially rectangular parallelepiped shape, a printer section 2 positioned in a lower portion of the housing 1*a*, and a scanner section 3 position in a upper portion of the housing 1*a*.

The printer section 2 has an opening 4 formed at a front side of the housing 1*a* as shown in FIG. 1, and comprises a paper-feed tray 5 configured to accommodate a plurality of sheets of printing paper as printing medium and a paper-discharge tray 6 configured to accommodate the plurality of sheets of printing paper on which images are printed. The paper-feed tray 5 and the paper-discharge tray 6 are disposed in the housing 1*a* with the former positioned below the latter, and the paper-feed tray 5 and the paper-discharge tray 6 are exposed to the outside of the printing apparatus 1 through the opening 4. The printer section 2 comprises a hinged cover 7 provided at the right lower portion of the front side of the housing 1*a* as shown in FIG. 1, so as to be opened and closed, and comprises an ink supply device 8 (see FIG. 2) disposed in the housing 1*a* behind the hinged cover 7 in FIG. 1. When the hinged cover 7 is opened, the ink supply device 8 is exposed to the outside of the printing apparatus 1 at the front side of the housing 1*a*, and an ink cartridge 10 (see FIG. 2) is allowed to be inserted into and removed from the housing 1*a* in a horizontal direction. The ink supply device 8 comprises a mounting case 9 (see FIG. 2) configured to accommodate the ink cartridges 10 therein. In this printer section 2, for example, four colors of ink are used, and the interior of the mounting case 9 is divided into four spaces. Four ink cartridges 10 having four colors of ink, namely, cyan (C), magenta (M), yellow (Y), and black (Bk) stored therein, are configured to be mounted in the divided spaces, respectively. The number of the ink cartridge(s) 10 mounted in the mounting case is not limited to a specific number. For example, in another embodiment, the interior of the mounting case 9 may be divided into six spaces for accommodating six ink cartridges 10.

The scanner section 3 is configured as so-called a flatbed scanner. In other words, the scanner section 3 comprises a document cover 1*b* provided so as to be opened and closed at the top of the housing 1*a*. The scanner section 3 comprises a platen glass on which a document is placed below the document cover 1*b*, and an image sensor for reading an image on a document placed on the platen glass below the platen glass.

The printing apparatus 1 comprises an operating panel 11 for a user to operate the printer section 2 and the scanner section 3, provided at an upper portion of the front side of the housing 1*a*. The printing apparatus 1 also comprises a slot portion 12 for allowing loading of various compact memory cards as storage media, provided at an upper left portion of the front side of the housing 1*a*. The operating panel 11 comprises various operating buttons, and a liquid-crystal display 11*a* for displaying various kinds of information, and the printing apparatus 1 is configured to be operated when a user inputs operation instructions via the operating panel 11. In a case where the printing apparatus 1 is connected to an external computer, the printing apparatus 1 can also be operated on the basis of instructions transmitted from the computer via a printer driver or a scanner driver.

Figure 2:
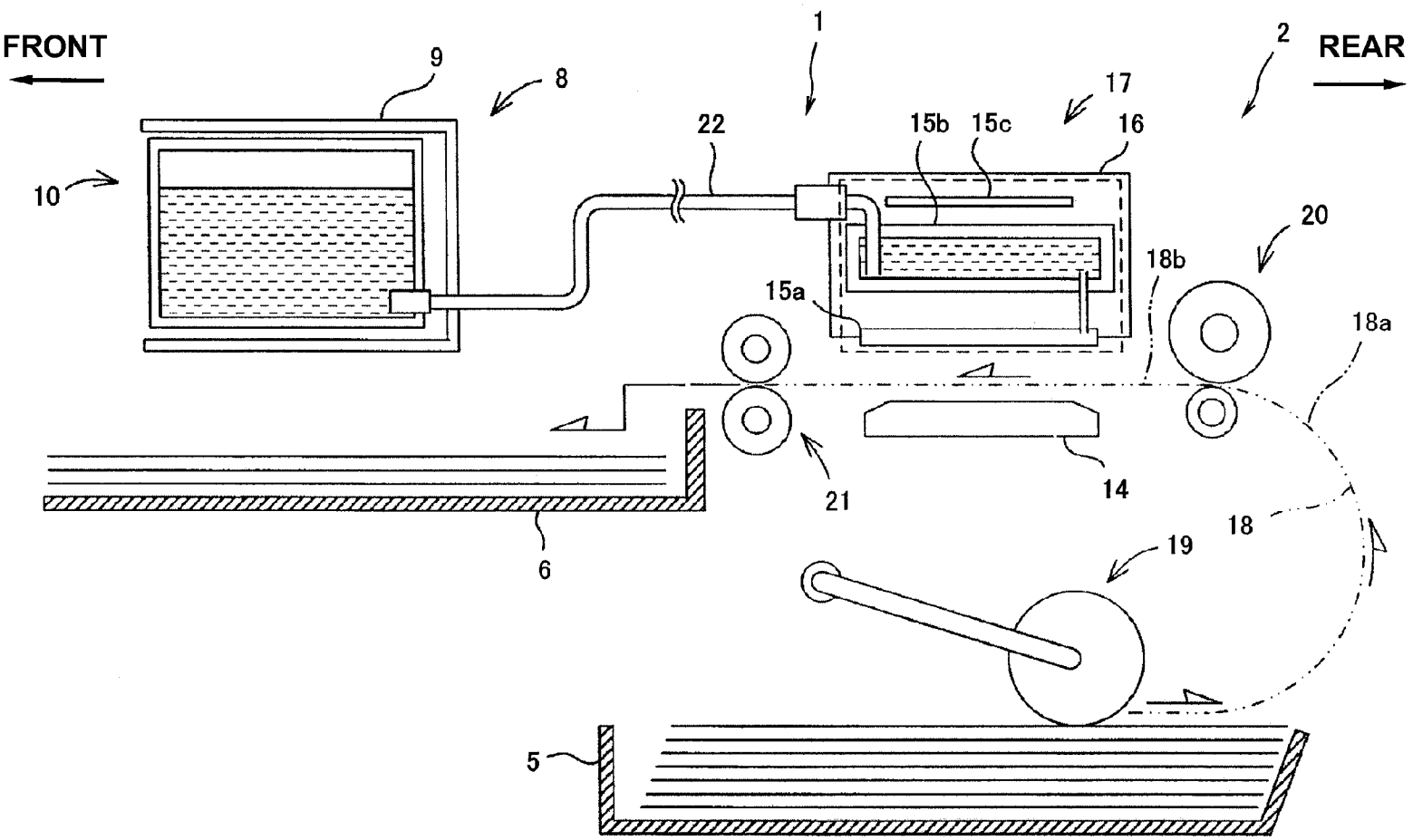
FIG. 2 is a schematic cross-sectional view of a printer section of the printing apparatus.

Referring to FIG. 2, the printer section 2 comprises a flat-plate shaped platen 14 elongated in a horizontal direction and provided above the paper-feed tray 5 which is provided at a bottom portion of the housing 1*a*. The printer section 2 also comprises an image printing unit 17 provided above the platen 14. The image printing unit 17 comprises a head unit 15*a* configured to eject ink from nozzles (not shown,) sub tanks 15*b* configured to supply ink to the head unit 15*a*, and a head control board 15*c* configured to output drive signals to an actuator, which is electrically connected to the head unit 15*a*. The sub tanks 15*b* provided in the image printing unit 17 are in fluid communication with the ink cartridges 10 mounted in the ink supply device 8 of the printing apparatus 1 via flexible tubes 22, respectively, and are configured to store ink supplied from the ink cartridges 10 temporarily therein and supply the stored ink further to the head unit 15*a*.

The printer section 2 comprises a guide rod (not shown) extending in a horizontal direction, and the image printing unit 17 is slidably supported by the guide rod (not shown) so as to reciprocate in the horizontal direction. The image printing unit 17 is coupled to a head driving mechanism comprising a pulley and a belt. The printing unit 17 is configured to reciprocate in a horizontal direction along the guide rod within a predetermined range in association with the driving of the head driving mechanism.

The printer section 2 comprises a paper transporting path 18 formed therein, and the paper transporting path 18 comprises a curved path 18*a* extending to the rear of the housing 1*a* from the paper-feed tray 5, and then extending upward and then to the front of the housing 1*a*. The paper transporting path 18 also comprises a straight path 18*b* extending further forward from an end of the curved path 18*a*. The printer section 2 comprises a paper-feeding roller 19 configured to feed a sheet of printing paper stored in the paper-feed tray 5 to the paper transporting path 18, provided immediately above the paper-feed tray 5. The printing section 2 comprises, along the paper transporting path 18, a transporting roller pair 20 comprising a transporting roller and a pinch roller and a paper-discharging roller pair 21 comprising a paper-discharging roller and a pinch roller, and each of the transporting roller pair 20 and the paper-discharging roller pair 21 is configured to pinch the sheet of printing from above and below, respectively, and transport the sheet along the paper transporting path 18.

With the printer section 2 configured as described above, the sheet of printing paper stored in the paper-feed tray 5 is fed by the paper-feeding roller 19 to the paper transporting path 18, and is transported by the transporting roller pair 20 along the paper transporting path 18 from the curved path 18*a* to the straight path 18*b*. An image is printed on the sheet of printing paper which reaches the straight path 18*b* with ink ejected from the head unit 15*a* provided in the image printing unit 17. When printing is completed, the sheet of printing paper is discharged from the straight path 18*b* by the paper-discharging roller pair 21 and to the paper-discharge tray 6.

Figure 3:
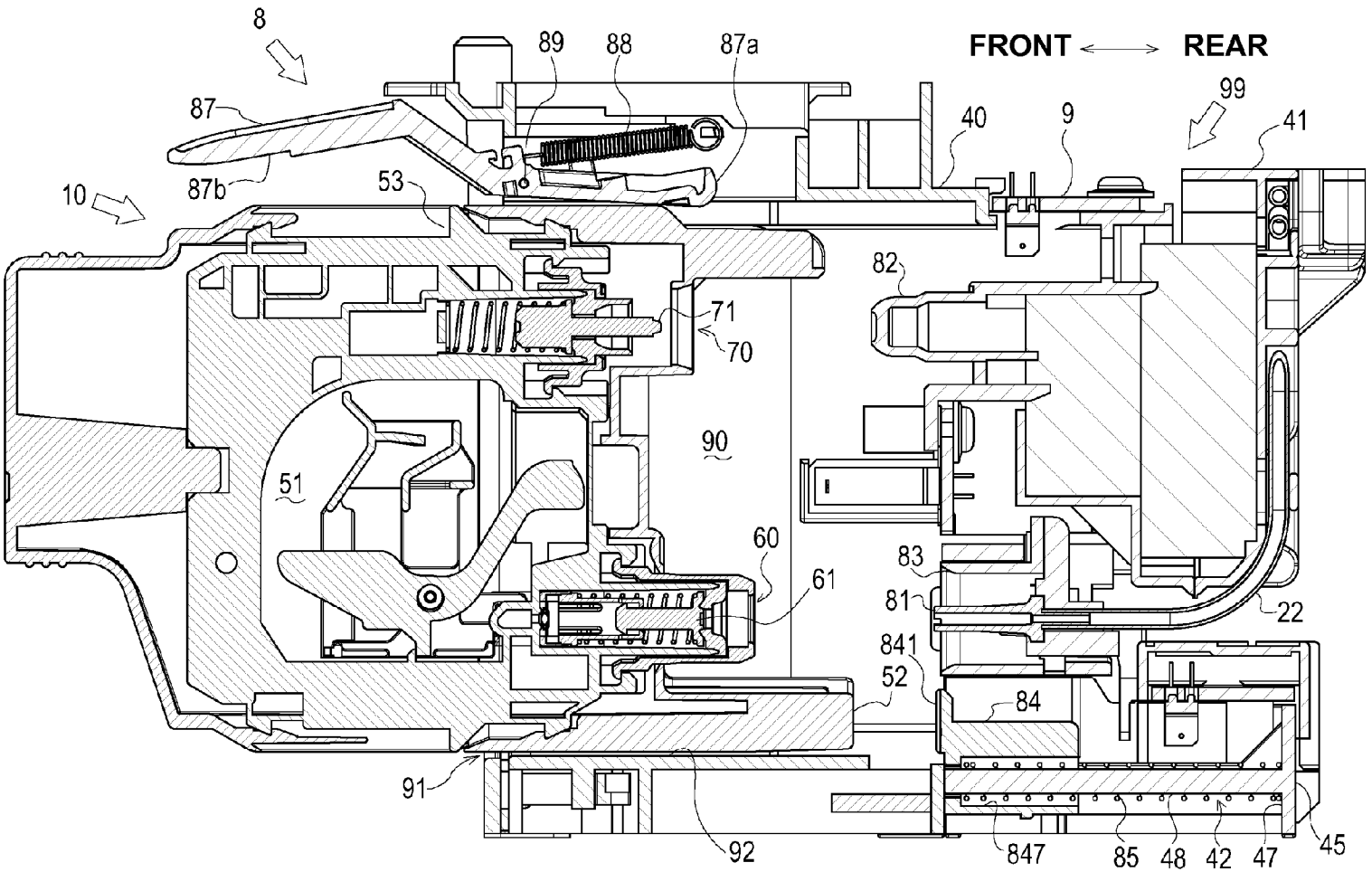
FIG. 3 is a vertical cross-sectional view of the liquid supply device taken along an insertion direction.

Referring to FIG. 3, the ink supply device 8 comprises the ink cartridges 10 and a mounting portion 99 having the mounting case 9 to which the ink cartridges 10 are removable mounted. In this embodiment, left in FIG. 3 is defined as "front" and right in FIG. 3 is defined as "rear".

Figure 4:
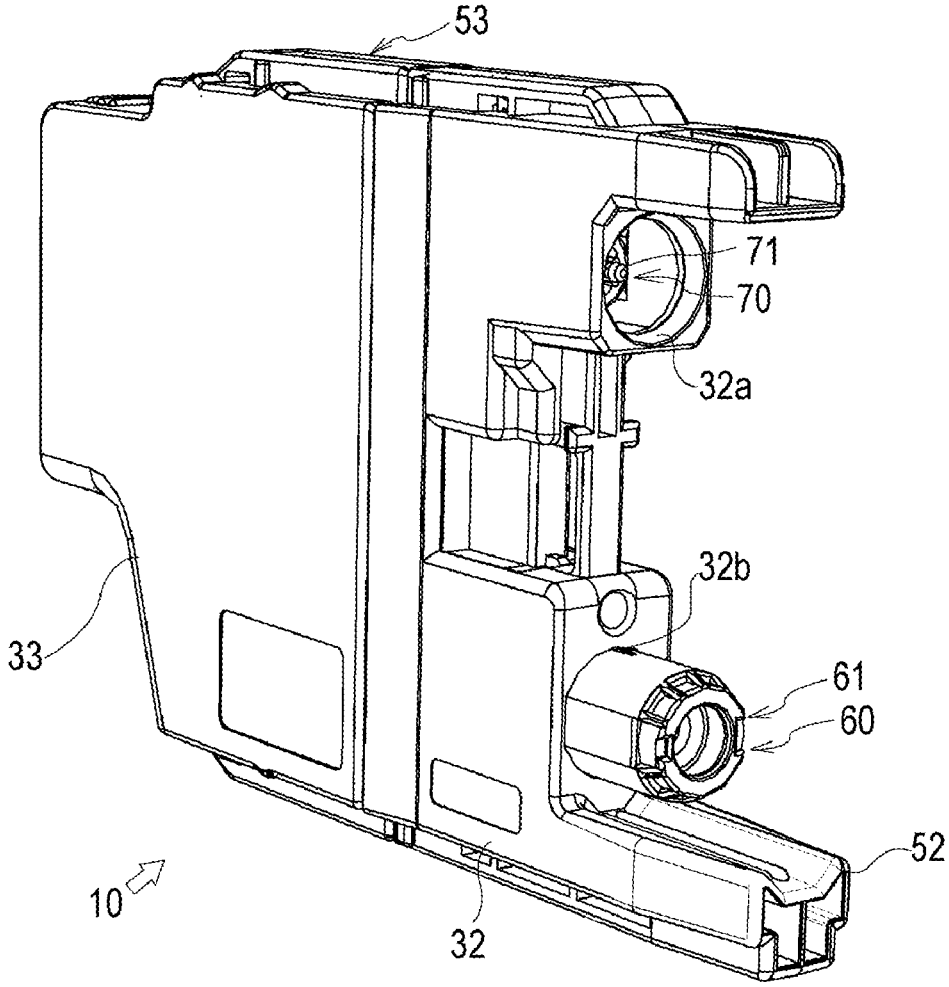
FIG. 4 is a perspective view of a liquid cartridge of the liquid supply device.
Figure 5A:
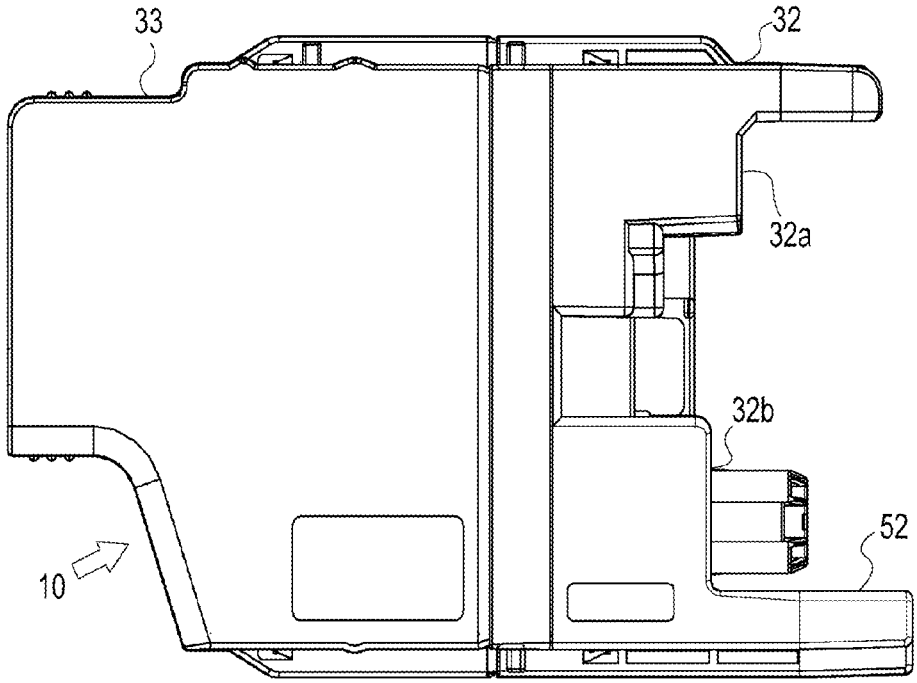
FIG. 5A is a side view of the liquid cartridge.
Figure 5B:
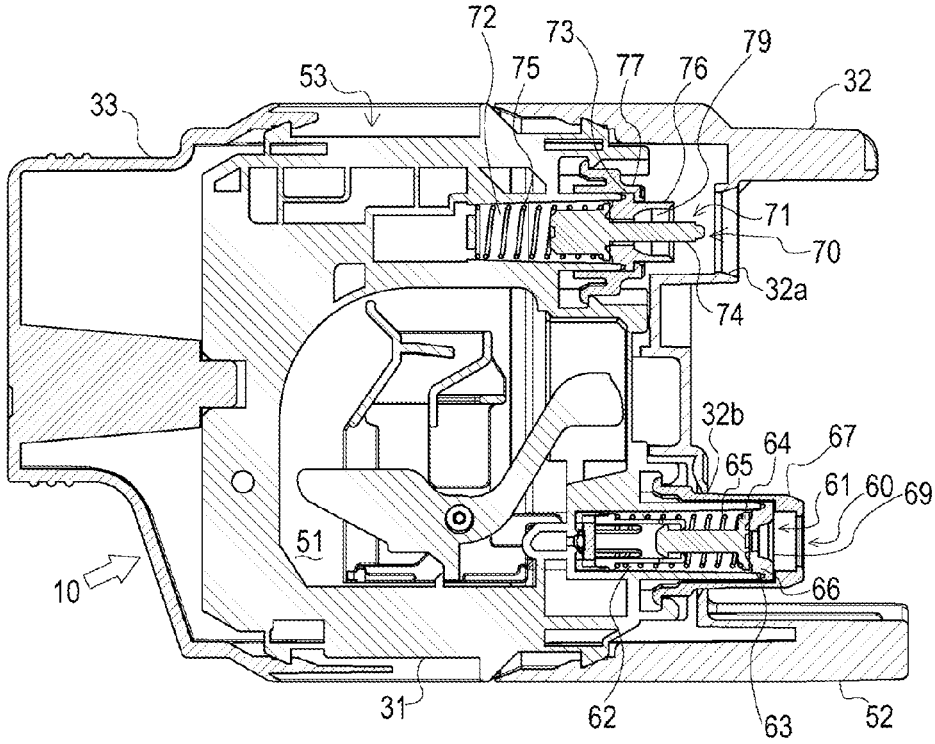
FIG. 5B is a side cross-sectional view of the liquid cartridge.

Referring to FIGS. 3, 4, 5A, and 5B, the ink cartridge 10 has substantially a rectangular parallelepiped shape, and each of the height and the depth of the ink cartridge 10 is less than the width of the ink cartridge 10 in an upright position shown in FIG. 4. The ink cartridge 10 is configured to be inserted into the mounting case 9 in the upright position shown in FIG. 4, in an insertion direction. The ink cartridge 10 comprises a case 31 comprising a front portion and a rear portion, a rear cover 32 which covers the rear portion of the case 31, and a front cover 33 which covers the front portion of the case 31. The case 31 comprises an ink chamber 51 having ink stored therein, and comprises an ink supply portion 60 configured to supply ink from the ink chamber 51 to the outside of the ink cartridge 10. The case 31 also comprises an air communication portion 70 configured to place the interior of the ink chamber 51 with the outside of the ink cartridge 10. The rear cover 32 comprises a rear surface facing rearward, and has an upper opening 32*a* formed at the rear surface for exposing the air communication portion 70 to the outside of the ink cartridge 10 and a lower opening 32*b* formed at the rear surface through which the ink supply portion 60 is inserted. The rear cover 32 also comprises a projecting portion 52 projecting rearward in a horizontal direction. The lower opening 32*b* is positioned below the upper opening 32*a* and the projecting portion 52 is positioned below the lower opening 32*b* when the ink cartridge 10 is inserted into the mounting case 9. The air communication portion 70 is positioned inward of the ink cartridge 10 relative to the upper opening 32*a* of the rear cover 32, the ink supply portion 60 penetrates through the lower opening 32*b* of the rear cover 32 rearward, and the projecting portion 52 projects further rearward than the ink supply portion 60 below the ink supply portion 60. The rear end of the projecting portion 52 is the rearmost position of the entire ink cartridge 10, and corresponds to a portion which is configured to contact a contact surface 841 of a slider 84 (described later) provided at the rear of the mounting case 9, when the ink cartridge 10 is inserted into the mounting case 9 in the insertion direction The air communication portion 70 is provided with an air communication valve 71. The air communication valve 71 is stored in a first valve storage chamber 72 formed in an upper rear portion of the case 31 as shown in FIG. 5B. The first valve storage chamber 72 is opened to the outside of the case 31 via an opening 73. The first valve storage chamber 72 communicates with the ink chamber 51 via a passage (not shown) at an end portion thereof opposite from the opening 73.

The air communication valve 71 comprises a valve body 74, a spring 75, a seal member 76, and a cap 77. Each of the seal member 76 and the cap 77 has a cylindrical shape. The seal member 76 is inserted into the opening 73 so as to close the opening 73, and the cap 77 is fitted around the seal member 76. The seal member 76 comprises an air communication port 79 formed so as to penetrate though the seal member 76 in the front-rear direction. The valve body 74 has a shaft shape, and is stored in the first valve storage chamber 72 so as to be movable reciprocally in the front-rear direction. A front portion of the valve body 74 is stored in the first valve storage chamber 72, and a rear portion thereof is inserted through the air communication port 79 of the seal member 76, and projects rearward from the air communication port 79. In addition, the spring 75 is disposed in the first valve storage chamber 72, and urges the valve body 74 rearward.

The valve body 74 urged rearward by the spring 75 is in tight contact with the seal member 76, so that the air communication port 79 is closed and thereby the air communication valve 71 is closed. When the ink cartridge 10 is mounted in the mounting case 9, the valve body 74 pressed by a valve operating pin 82 (described later) moves forward against an urging force of the spring 75, so that the air communication valve 71 is opened, and thereby the air communication port 79 is opened. The ink chamber 51 is placed in fluid communication with the outside of the ink cartridge 10 via a gap between the valve body 74 and an inner peripheral portion of the seal member 76 which defines the air communication port 79.

Similarly, the ink supply portion 60 comprises an ink supply valve 61. Referring to FIG. 5B, the ink supply valve 61 is stored in a second valve storage chamber 62 formed in a rear lower portion of the case 31. The second valve storage chamber 62 is opened to the outside of the case 31 via an opening 63. The second valve storage chamber 62 communicates with the ink chamber 51 via a passage (not shown) at an end portion thereof opposite from the opening 63.

The ink supply valve 61 comprises a valve body 64, a spring 65, a seal member 66, and a cap 67. The valve body 64 has a shaft shape with a flange at a rear portion thereof. The axis of the shaft-shaped valve body 64 extends in the front-rear direction. Each of the seal member 66 and the cap 67 has a cylindrical shape and has a through hole formed therethrough in the front-rear direction. The seal member 66 is inserted into the opening 63 so as to close the opening 63, and the cap 67 is fitted around the seal member 66. The through hole of the seal member 66 and the through hole of the cap 67 form an ink supply port 69. The valve body 64 is provided so as to be movable reciprocally in the front-rear direction in the second valve storage chamber 62 inward of the ink cartridge 10 relative to the seal member 66. The valve body 64 is positioned between the ink chamber 51 and the seal member 66. In addition, the spring 65 is disposed in the second valve storage chamber 62, and urges the valve body 64 rearward.

The ink supply port 69 formed by the through hole of the seal member 66 and the through hole of the cap 67 is closed by the flange of the valve body 64, which is urged by the spring 65 and is in tight contact with the seal member 66, such that the ink supply valve 61 is closed. When the ink cartridge 10 is mounted in the mounting case 9, the valve body 64 is moved rearward by an ink supply tube 81 (described later) against the urging force of the spring 65, and is moved away from the seal member 66, whereby the ink supply valve 61 is opened. Consequently, the ink chamber 51 is brought into communication with the tube 22 connected to the ink supply device 8 via the ink supply tube 81 inserted into the ink supply port 69, such that ink in the ink chamber 51 is supplied to the sub tank 15*b* via the tube 22.

Figure 6:
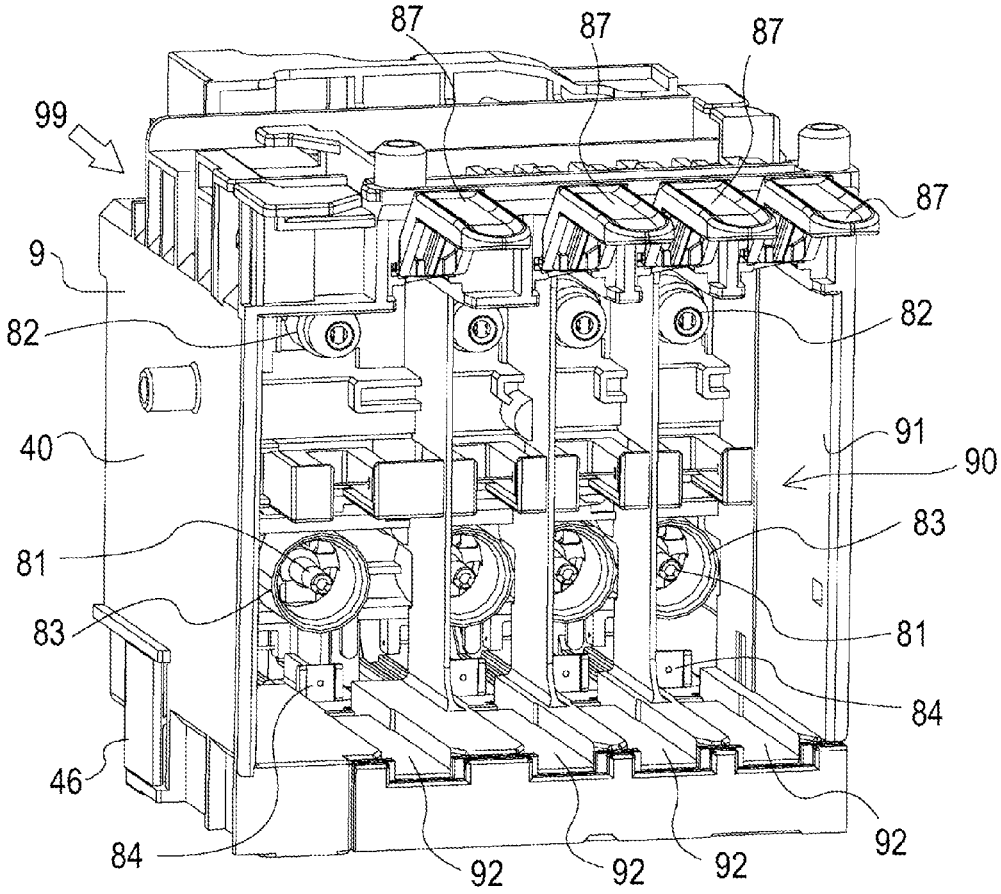
FIG. 6 is a perspective view of a mounting case of the liquid supply device.
Figure 7:
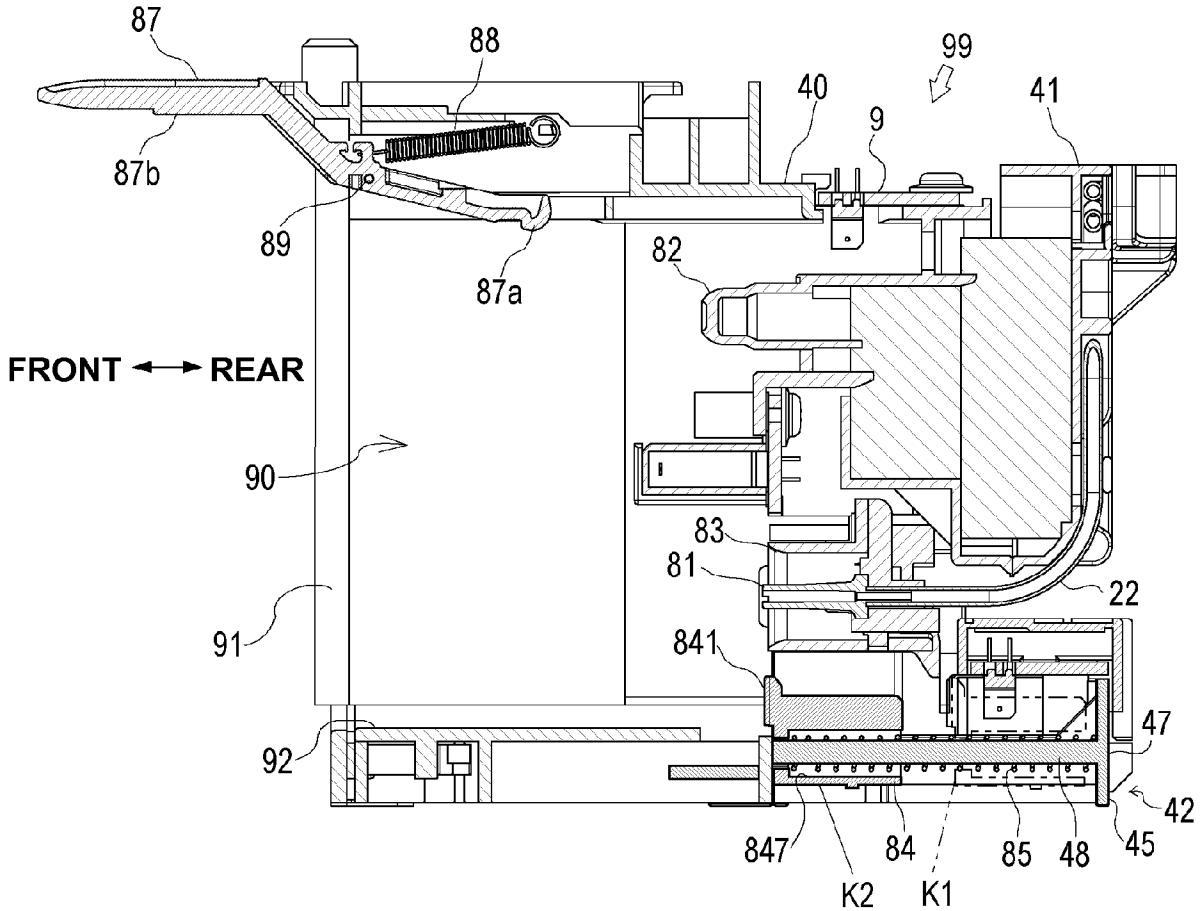
FIG. 7 is a vertical cross-sectional view of the mounting case taken along the insertion direction.
Figure 8:
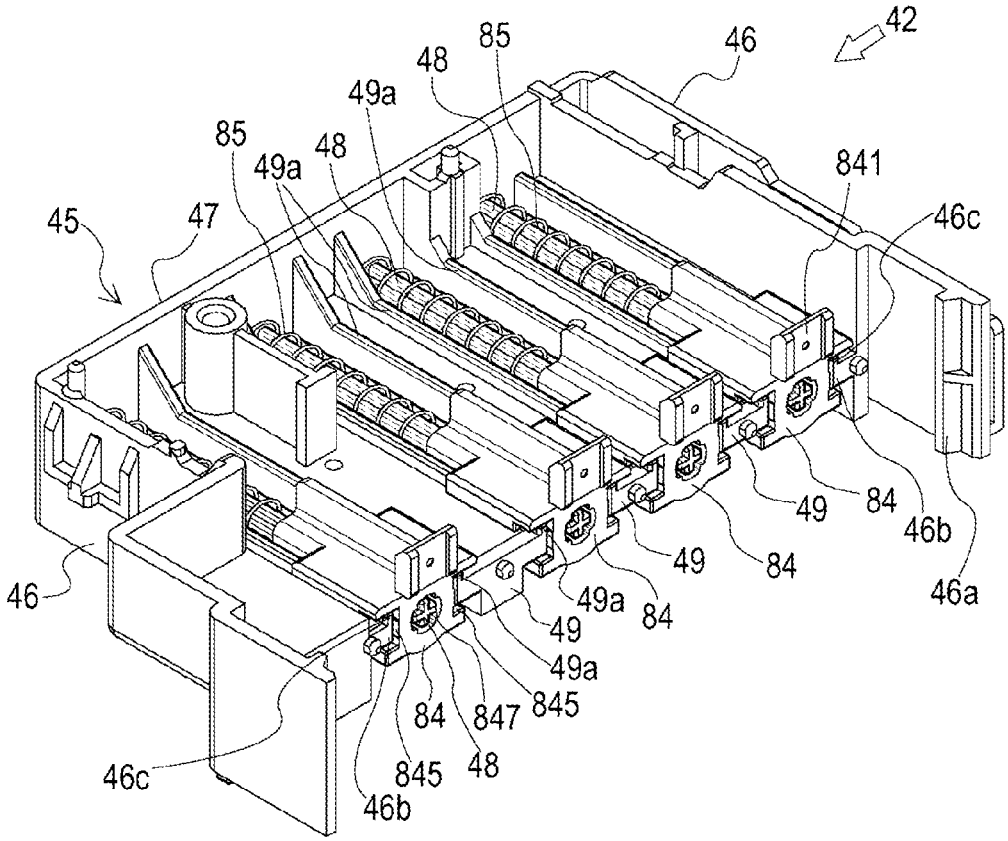
FIG. 8 is a perspective view of a liquid cartridge urging unit of the liquid supply device.
Figure 9:
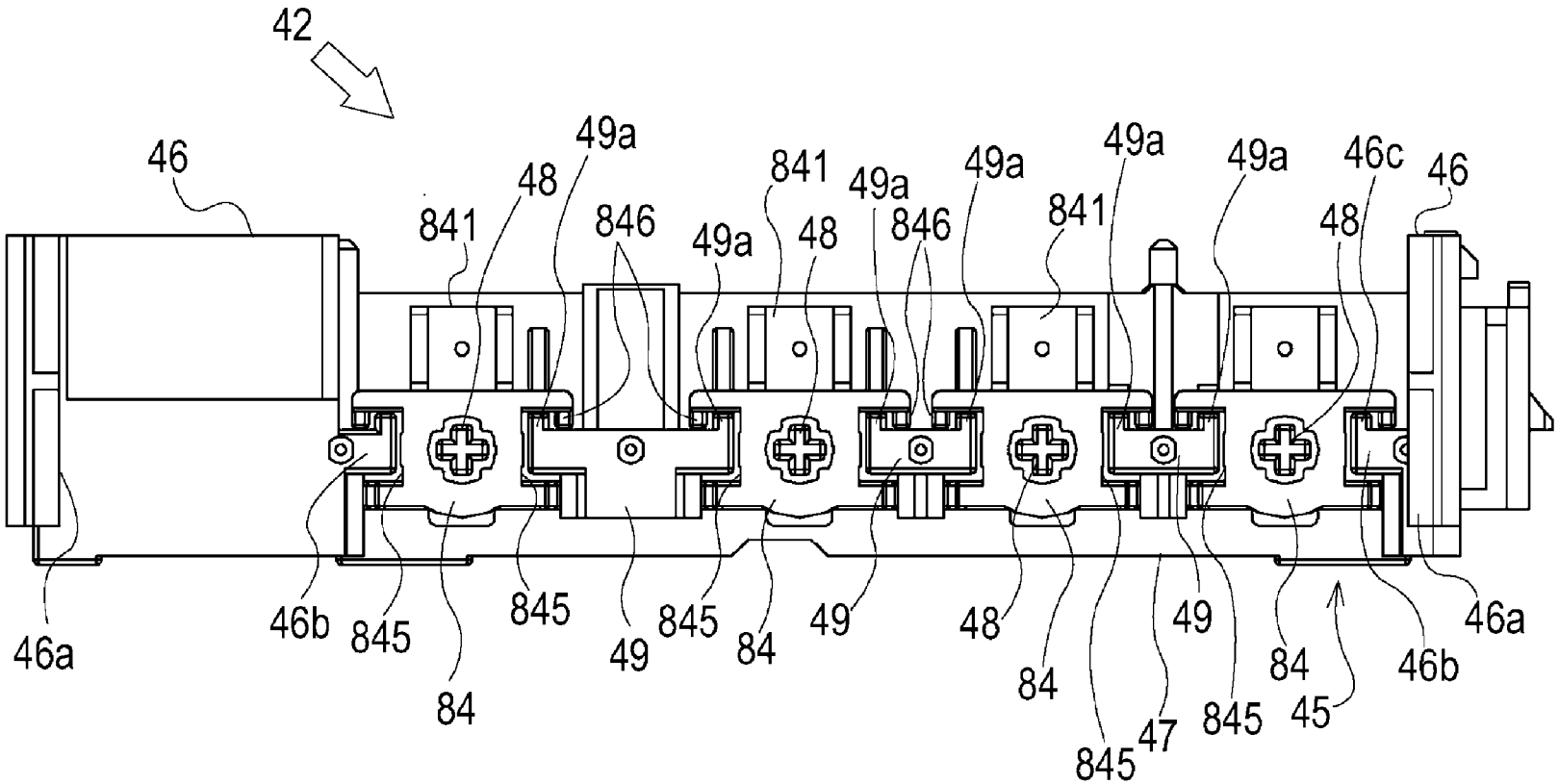
FIG. 9 is a front view of the liquid cartridge urging unit.
Figure 10A:
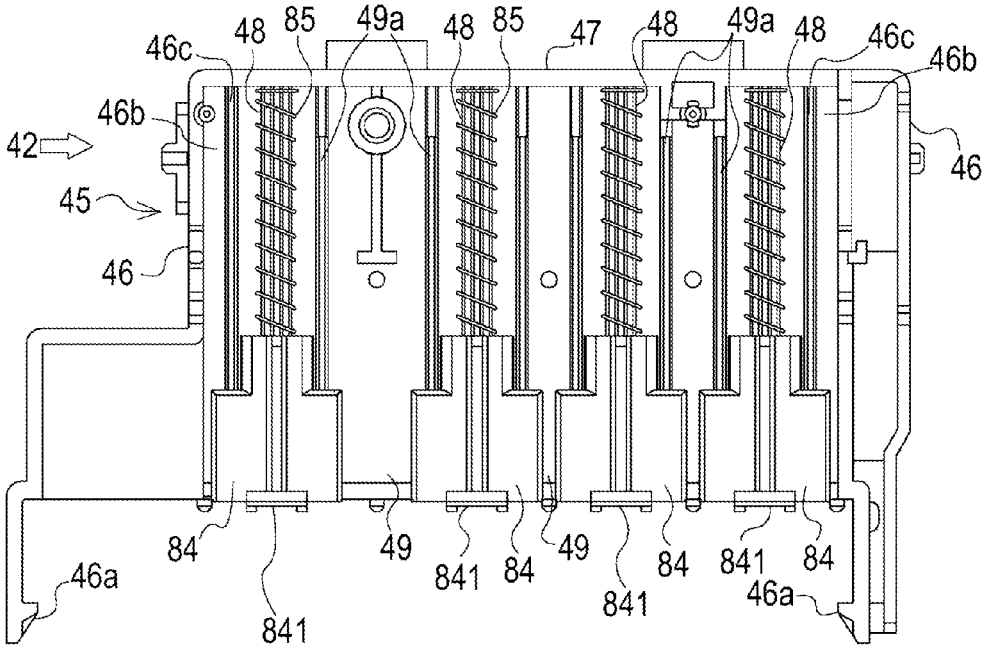
FIG. 10A is a top view of the liquid cartridge urging unit.
Figure 10B:
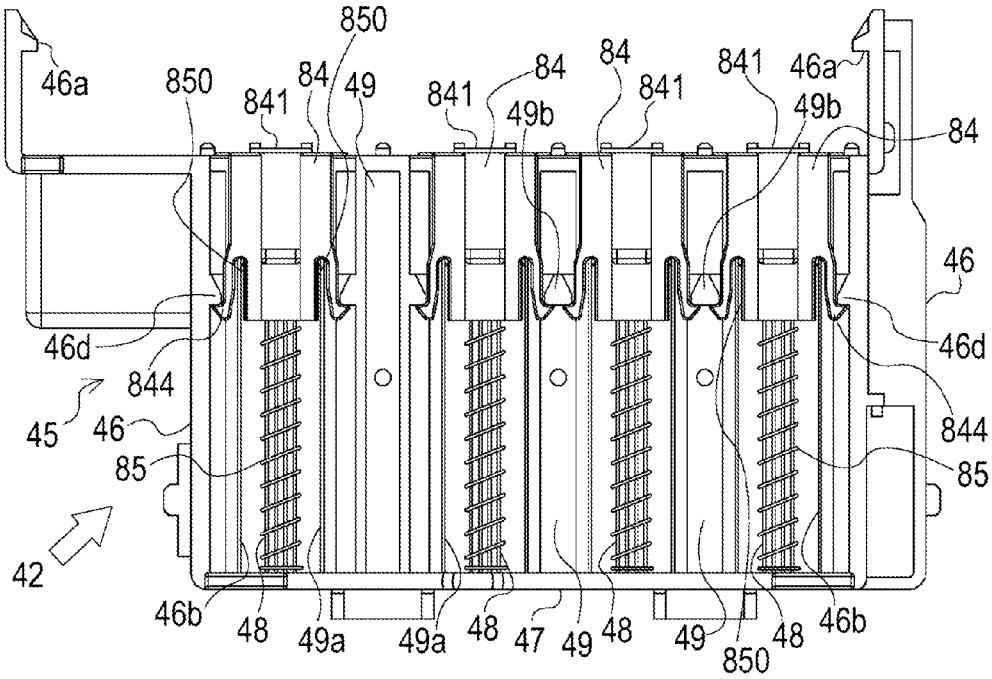
FIG. 10B is a bottom view of the liquid cartridge urging unit.

Referring to FIGS. 6 and 7, the mounting portion 99 comprises the mounting case 9, and the mounting case 9 has four mounting spaces 90 formed therein. Each mounting space 90 has substantially a rectangular parallelepiped shape. The mounting case 9 has an insertion/removal opening 91 opened forward. The mounting spaces 90 are exposed to the outside of the mounting case 9 via the insertion/removal opening 91. The mounting case 9 comprises a closed inner wall surface opposite the insertion/removal opening 91 in the insertion direction. The mounting case 9 also comprises a bottom surface extending rearward (extending in the insertion direction) from the insertion/removal opening 91 to the closed inner wall surface. The ink cartridge 10 is configured to be mounted to the mounting case 9 by being inserted rearward in the insertion direction from the insertion/removal opening 91, and the mounted ink cartridge 10 is configured to be removed from the mounting case 9 by being moved forward in a removal direction. The remove direction is opposite to the insertion direction, and each of the insertion direction and the removal direction is a horizontal direction in this embodiment. The insertion direction and the removal direction in combination are referred to as an insertion/removal direction. A direction which is perpendicular to the insertion/removal direction and parallel to the direction of gravity is referred to as a vertical direction, and a direction which is perpendicular to the insertion/removal direction and the vertical direction is referred to as a lateral direction.

The mounting case 9 comprises a square tubular-shaped case body 40 opened on both ends in the insertion/removal direction, and a connecting unit 41 and a liquid cartridge urging unit 42 fixed to the case body 40 so as to close an end of the case body 40 facing in the insertion direction. The connecting unit 41 closes an upper portion of the case body 40 at the end of the case body 40 facing in the insertion direction, and the liquid cartridge urging unit 42 closes a lower portion of the case body 40 at the end of the case body 40 facing in the insertion direction. The connecting unit 41 forms the closed inner wall surface opposite the insertion/removal opening 91. The mounting case 9 has four mounting spaces 90 corresponding to the number of the ink cartridges 10 to be mounted in the mounting case 9. The mounting portion 99 comprises the ink supply tube 81, the valve operating pin 82, the slider 84, and an urging member 85 provided at the back of the mounting case 9, a guide groove 92 provided in the bottom surface of the mounting case 9, and a lock lever 87 provided at an upper portion of the mounting case 9 for each of the mounting spaces 90. In this embodiment, four ink cartridges 10 are configured to be mounted to the mounting portion 99. However, the number of the ink cartridges 10 to be mounted in the mounting portion 99 is not limited thereto.

The connecting unit 41 which forms the upper portion of the inner wall surface of the mounting case 9 comprises four ink supply tubes 81. Each ink supply tube 81 is a hollow member penetrating through the inner wall surface of the mounting case 9 and extending from the inner wall surface in the removal direction. An end of the tube 22, which is opposite the end thereof connected to the sub tank 15*b*, is connected to a rear end of the ink supply tube 81. The ink supply tube 81 is positioned so as to be inserted into the ink supply port 69 of the ink cartridge 10 mounted to the mounting case 9. When the ink supply tube 81 is inserted into the ink supply port 69 of the ink cartridge 10 mounted in the mounting space 90, the ink chamber 51 of the ink cartridge 10 and the sub tank 15*b* are in fluid communication via the tube 22 and the ink supply tube 81.

The connecting unit 41 comprises cylindrical guide cylinders 83 surrounding the ink supply tubes 81, respectively, and positioned concentrically to the ink supply tubes 81, respectively. The guide cylinders 83 extend from the inner wall surface of the mounting case 9 in the removal direction. The guide cylinder 83 is configured to receive the ink supply portion 60 of the ink cartridge 10, and the inner peripheral surface of the guide cylinder 83 has a diameter which allows the outer peripheral surface of the cap 67 of the ink supply portion 60 to slide on the inner peripheral surface of the guide cylinder 83. When the ink cartridge 10 is mounted to the mounting space 90, the guide cylinder 83 guides the insertion of the ink supply tube 81 into the ink supply port 69. When the ink cartridge 10 is mounted in the mounting space 90, the guide cylinder 83 holds the ink supply portion 60 and the ink supply tube 81 without causing displacement therebetween.

The connecting unit 41 comprises the four valve operating pins 82 projecting from the inner wall surface of the mounting case 9 in the removal direction above the ink supply tubes 81. The valve operating pin 82 is positioned so as to contact the air communication valve 71 projecting from the air communication port 79 of the ink cartridge 10 mounted in the mounting case 9, so that the air communication valve 71 is operated so as to open the air communication port 79 while the ink cartridge 10 is mounted in the mounting space 90.

The liquid cartridge urging unit 42 forming the lower portion of the inner wall surface of the mounting case 9 comprises four sliders 84 at the back of the mounting case 9 below the ink supply tubes 81. The liquid cartridge urging unit 42 further comprises four urging members 85 which urge the respective sliders 84 in the removal direction. Referring to FIGS. 8, 9, 10A, and 10B, the four sets of the sliders 84 and the urging members 85 are configured as a single assembled unit.

The liquid cartridge urging unit 42 comprises a unit frame 45 configured to be attached to the case body 40. The unit frame 45 is formed into substantially a U-shape in plan view comprising substantially parallel side portions 46, 46 extending in the insertion/removal direction, and a connecting portion 47. Each of the side portions 46, 46 comprises a first end facing in the insertion direction, and the connecting portion 47 connects the first ends of the two side portions 46, 46. The unit frame 45 comprises four rail bars 48, which correspond to the four sliders 84, positioned between the side portions 46, 46, and three guide bars 49, each of which is positioned between adjacent rail bars 48, 48. The rail bars 48 and the guide bars 49 are all positioned on a plane surrounded by the two side portions 46, 46 and the connecting portion 47 of the unit frame 45. Ends of the rail bars 48 and the guide bars 49 facing in the insertion direction are connected to the connecting portion 47, and the rail bars 48 and the guide bars 49 extend from the connecting portion 47 in the removal direction.

The unit frame 45, the rail bars 48, and the guide bars 49 are integrally resin-molded. Ends of the two side portions 46, 46, the respective rail bars 48, and the respective guide bars 49 facing in the insertion direction are fixed to the connecting portion 47, and ends of the two side portions 46, 46, the respective rail bars 48, and the respective guide bars 49 facing in the removal direction are free ends. Therefore, the two side portions 46, 46 can be resiliently deformed into a fan-like shape, such that the distance between the ends facing in the removal direction of the two side portions 46, 46 is widened. The two side portions 46, 46 comprise projections 46*a*, 46*a* projecting inward from the surfaces of the two side portions 46, 46 opposing to each other at the ends facing in the removal direction. The projections 46*a*, 46*a* are attachment portions configured to be attached to the case body 40. When the liquid cartridge urging unit 42 is intended to be attached to the case body 40, the case body 40 is inserted between the ends of the side portions 46, 46 facing in the removal direction while the unit frame 45 is resiliently deformed, such that the distance between the ends of the two side portions 46, 46 facing in the removal direction is widened, and then the projections 46*a*, 46*a* are engaged with the recesses (not shown) formed in the case body 40. The liquid cartridge urging unit 42 is thus attached to the case body 40. Because the unit frame 45 can be resiliently deformed as described above, the attachment portions may be simple projections or the like and specific attachment tools are not required. Therefore, downsizing and cost reduction owing to the reduction in number of components, and improvement of assembleability of the liquid cartridge urging unit 42 to the case body 40 of the mounting case 9 are achieved.

The rail bar 48 is loosely inserted into a through hole 847 which is formed through the slider 84 in the insertion/removal direction. The guide bar 49 positioned between the adjacent sliders 84, 84 is configured to guide the movement of both of these sliders 84, 84. The slider 84 has guide grooves 845, 845 formed in the side end surfaces on both sides of the slider 84 in the lateral direction, and the guide grooves 845, 845 extend in the insertion/removal direction. The guide groove 845 is defined by a vertical surface extending in the vertical direction, and an upper surface and a lower surface extending toward the guide bar 49 in the lateral direction from upper and lower ends of the vertical surface, respectively. In addition, the guide groove 845 is formed with a lip (projecting ridge) 846 extending in the insertion/removal direction and projecting downward from the upper surface at an end of the upper surface adjacent to the guide bar 49. On the other hand, the guide bar 49 has a lip (projecting ridge) 49*a* extending in the insertion/removal direction and projecting upward from each end of the upper surface of the guide bar 49 in the lateral direction. Each of the side end portions of the guide bar 49 is fitted into the guide groove 845 of the slider 84, and the lip 49*a* of the guide bar 49 is positioned inside the guide groove 845 beyond the lip 846 of the slider 84. The lip 49*a* of the guide bar 49 and the lip 846 of the slider 84 are overlapped in the lateral direction. In other words, the lip 846 of the slider 84 and the lip 49*a* of the guide bar 49 fitted into the guide groove 845 of the slider 84 engage with each other. In this manner, with the presence of the side end portions of the guide bars 49, 49 in the respective guide grooves 845, 845 of the slider 84, the slider 84 is guided to move along the guide bars 49, 49 in the insertion/removal direction without rotating within a plane perpendicular to the insertion/removal direction about the rail bar 48. Furthermore, by the mutual engagement of the engagement portions (lips 846 and 49*a*) of the slider 84 and the guide bar 49 which guides the slider 84, the slider 84 and the guide bar 49 which guides the slider 84 are restrained from moving in the lateral direction which is perpendicular to the insertion/removal direction. In other words, the engagement portions (lips 846 and 49*a*) are configured to restrict movements of the slide 84 and the guide bar 49 separating from each other in the lateral direction.

Similarly to the guide bar 49, a portion of the side portion 46 opposing the rail bar 48 comprises a guide portion 46*b* configured to be fitted into the guide groove 845 of the slider 84, and the guide portion 46*b* extends in the insertion/removal direction. The guide portion 46*b* comprises a lip (projecting ridge) 46*c* at an end of the upper surface thereof in the lateral direction adjacent to the slider 84, and the lip 46*c* extends in the insertion/removal direction and projects upward from the upper surface of the lip 46*c*. The guide portion 46*b* of the side portion 46 is fitted into the guide groove 845 of the slider 84, and the lip 46*c* of the guide portion 46*b* is positioned inside the guide groove 845 beyond the lip 846 of the slider 84. The lip 46*c* of the guide portion 46*b* and the lip 846 of the slider 84 are overlapped in the lateral direction. In other words, the lip 846 of the slider 84 and the lip 46*c* of the guide portion 46*b* of the side portion 46 fitted into the guide groove 845 of the slider 84 engage with each other. In this manner, with the presence of the side end portion of the guide bar 49 and the guide portion 46*b* of the side portion 46 in the respective guide grooves 845, 845 of the slider 84, the slider 84 positioned between the side portion 46 and the guide bar 49 is guided to move in the insertion/removal direction without rotating within a plane perpendicular to the insertion/removal direction about the rail bar 48. Furthermore, by the mutual engagement of the engagement portions (lips 846 and 46*c*) of the slider 84 and the side portion 46 which guides the slider 84, the slider 84 and the side portion 46 which guides the slider 84 are restrained from moving in the lateral direction perpendicular to the insertion/removal direction. In other words, the engagement portions (lips 846 and 46*c*) are configured to restrict movements of the slide 84 and the side portion 46 separating from each other in the lateral direction.

As described above, the slider 84 is configured to move on the rail bar 48 in the insertion/removal direction. More specifically, the slider 84 is configured to move reciprocally between a mount position K1 and a release position K2. The mount position K1 is away from the release position K2 in the insertion direction. In FIG. 7, the slider 84 at the mount position K1 is indicated by a double-dashed chain line, and the slider 84 at the release position K2 is indicated by a solid line. The slider 84 comprises the contact surface 841 at an end thereof facing in the removal direction, and the contact surface 841 is configured to contact an end of the projecting portion 52 of the ink cartridge 10. When the ink cartridge 10 contacts the slider 84 at the mount position K1, the ink cartridge 10 is mounted in the mounting space 90 while the valve body 64 of the ink supply valve 61 is pressed by the ink supply tube 81 and hence the ink supply port 69 is opened, and the valve body 74 of the air communication valve 71 is pressed by the valve operating pin 82 and hence the air communication port 79 is opened. In contrast, when the ink cartridge 10 contacts the slider 84 at the release position K2, the ink cartridge 10 is released from the mounted state of being mounted in the mounting space 90, and the ink supply port 69 and the air communication port 79 are closed.

The urging member 85 configured to urge the slider 84 in the removal direction is positioned between the connecting portion 47 and the slider 84 and between the two guide bars 49, 49 adjacent to the slider 84, or between the side portion 46 and the guide bar 49 adjacent to the slider 84. In this manner, arrangement of the urging member 85 within the unit frame 45 contributes to downsizing of the liquid cartridge urging unit 42. The urging member 85 according to this embodiment is a compressed coil spring fitted around the outer periphery of the rail bar 48, and is compressed between the connecting portion 47 and the slider 84. Because the rail bar 48 is inserted through the coil spring as the urging member 85, bending of the coil sprig is prevented, such that the slider 84 can be moved stably. However, the urging member 85 is not limited to the compressed coil spring, and may be of any member as long as it can urge the urging member 85 in the removal direction. In another embodiment, the urging member 85 may be an extension coil spring configured to pull the slider 84 in the removal direction or may be a resilient foamed member configured to press the slider 84 in the removal direction.

The contact surface 841 of the slider 84 at the release position K2 is positioned substantially right below the distal end (end facing in the removal direction) of the ink supply tube 81. The slider 84 comprises claws 844, 844 on both sides of the lower surface thereof, respectively, and each of the claws 844, 844 overlaps with the guide bar 49 or the guide portion 46*b* of the side portion 46 in the vertical direction. The guide bar 49 comprises a stopper 49*b* at the lower surface thereof, and the stopper 49*b* is configured to contact the claw 844 of the slider 84 moving in the removal direction. The guide portion 46*b* of the side portion 46 comprises a stopper 46*d* at the lower surface thereof, and the stopper 46*d* is configured to contact the claw 844 of the slider 84 moving in the removal direction. When the slider 84 reaches the release position K2, the claw 844 comes into contact with the stopper 49*b* or the stopper 46*d* in the insertion/removal direction. The surface of the claw 844 which comes into contact with the stopper 49*b* or the stopper 46*d* is a surface perpendicular to the insertion/removal direction. The surfaces of the stopper 49*b* and the stopper 46*d* which come into contact with the claw 844 are also surfaces perpendicular to the insertion/removal direction. Accordingly, the claw 844 is engaged with the stopper 49*b* or the stopper 46*d*, and the slider 84 at the release position K2 is prevented from moving further in the removal direction. Because the two sliders 84, 84 are positioned on both sides of the one guide bar 49, the one stopper 49*b* of the one guide bar 49 is configured to engage with two claws 844, 844 of the two sliders 84, 84. In this manner, the adjacent two sliders 84, 84 share the single guide bar 49, and also share the single stopper 49*b* of the guide bar 49. Therefore, the spaces occupied by the guide bar and the stopper can be reduced in comparison with the case where a predetermined number of the guide bars or the stoppers are provided respectively for the respective sliders 84, and therefore further downsizing of the liquid cartridge urging unit 42 is realized. The downsizing of the liquid cartridge urging unit 42 contributes to downsizing of the 1 mounting portion 99, or even downsizing of the printing apparatus 1. The lower surface of the slider 84 has two slits 850, 850 formed therein and the slits 850, 850 extend from the rear end of the slider 84 in the removal direction. The slits 850, 850 are positioned closer to the center of the slider 84 than the claws 844, 844 in the lateral direction. With the provision of the slits 850, 850, portions of the slider 84 comprising the claws 844, 844 are separated from the other portion of the slider 84 in the lateral direction, and are resiliently deformable independently of the other portion of the slider 84.

When the liquid cartridge urging unit 42 is intended to be assembled, the rail bar 48 is inserted into the urging members 85. Then, the rail bar 48 inserted into the urging member 85 is inserted into the slider 84. When the slider 84 is moved in the insertion direction toward the connecting portion 47 while the side end portion of the guide bar 49 or the guide portion 46*b* is positioned in the guide grooves 845 of the slider 84, an end of the claw 844 facing in the insertion direction comes into contact with the stopper 49*b* or the stopper 46*d*. Because the end of the claw 844 facing in the insertion direction is inclined such that the claw 844 is moved toward the center of the slider 84 when coming into contact with the stopper 49*b* or the stopper 46*d* while being resiliently deformed, and because an end of the stopper 49*b* or the stopper 46*d* facing in the removal direction is inclined along the inclined surface of the end of the claw 844 facing in the insertion direction, the slider 84 can be moved in the insertion direction by climbing over the stopper 46*d* or the stopper 49*b* while the portions of the slider 84 comprising the claws 844 are resiliently deformed toward the center of the slider 84 in the lateral direction. Once the claw 844 has climbed over the stopper 49*b* or the stopper 46*d* in the insertion direction, even when the slider 84 moves in the removal direction, the surface of the claw 844 facing in the removal direction and the surface of the stopper 49*b* or the stopper 46*d* facing in the insertion direction come into contact and engage with each other. Therefore, the claw 844 does not climb over the stopper 49*b* or the stopper 46*d* and does not move further in the removal direction, and the slider 84 stays at the release position K2 against the urging force of the urging member 85. The side portion 46 and the slider 84 adjacent to each other or the guide bar 49 and the slider 84 adjacent to each other are coupled in the lateral direction perpendicular to the insertion/removal direction with the aid of the lips 846, 49*a* and 46*c*. By repeating this operation by the number of the sliders 84 (four in this embodiment), the assembly of the liquid cartridge urging unit 42 is completed.

As described above, the unit frame 45 can be resiliently deformed into a fan shape, such that the distance between the ends of the two side portions 46, 46 facing in the removal direction is widened. Therefore, if the slider 84 and the side portion 46 or the guide bar 49 adjacent to each other were not coupled in the lateral direction, the unit frame 45 would be resiliently deformed, such that the guide bar 49 and the side portion 46 can move away from the slider 84 in the lateral direction. If the distance between the guide bars 49, 49 adjacent to each other or between the guide bar 49 and the side portion 46 were widened in the lateral direction in this manner, the engagement between the claw 844 and the stopper 49*b* or the stopper 46*d* would be released, and the slider 84 retained at the release position K2 would be moved in the removal direction from the release position K2 by being urged by the urging member 85, thereby the slider 84 would come off the unit frame 45. Nevertheless, in the liquid cartridge urging unit 42 according to this embodiment, because the slider 84 and the side portion 46 or the guide bar 49 adjacent to each other are coupled and restrict the mutual movement in the lateral direction perpendicular to the insertion/removal direction by the engagement portions thereof (lips 49*a*, 846, 46*c*), the resilient deformation of the unit frame 45 is restricted, and the likelihood that the slider 84 comes off the unit frame 45 is reduced. In this manner, the assembleability of the liquid cartridge urging unit 42 can be improved while the downsizing of the liquid cartridge urging unit 42 can also be realized.

There is a little play between the slider 84 and the guide bar 49 engaged with each other and also between the slider 84 and the guide portion 46*b* of the side portion 46 engaged with each other. Therefore, even though the slider 84 and the guide bar 49 or the side portion 46 adjacent thereto are coupled in the lateral direction perpendicular to the insertion/removal direction by the engagement between the engagement portions (lip 846, 49*a*, and 46*c*), the movement of the slider 84 in the insertion/removal direction is not hindered thereby.

Returning back to FIGS. 6 and 7, the case body 40 has the insertion/removal opening 91 at an end thereof facing the removal direction, and has the four parallel guide grooves 92 formed in the inner bottom surface thereof, extending from the insertion/removal opening 91 in the insertion direction. In addition, the case body 40 comprises the four lock levers 87 at the inner top surface thereof opposite the respective guide grooves 92. The lock lever 87 is configured to releasably retain the ink cartridge 10 in contact with the slider 84 at the mount position K1, such that the ink cartridge 10 does not move in the removal direction.

The lock lever 87 is supported by a supporting shaft 89 positioned adjacent to the insertion/removal opening 91 of the mounting case 9. A portion of the lock lever 87 positioned on an insertion-direction side relative to the supporting shaft 89 is an acting portion 87*a* positioned in the mounting case 9, and a portion of the lock lever 87 positioned on a removal-direction side relative to the supporting shaft 89 is an operating portion 87*b* positioned outside of the mounting case 9 via the insertion/removal opening 91. Both portions are pivotable about the supporting shaft 89. An urging member 88, e.g., a pulling coil spring, is provided between the lock lever 87 and the mounting case 9, and the acting portion 87*a* is urged downward and the operating portion 87*b* is urged upward. The acting portion 87*a* of the lock lever 87 is configured to be fitted into a locking groove 53 (see FIG. 5B) formed in the upper surface of the ink cartridge 10, such that the movement of the ink cartridge 10 in the removal direction can be restricted.

The ink cartridge 10 is configured to be inserted from the insertion/removal opening 91 of the mounting case 9 into the mounting space 90 in a state that the ink cartridge 10 stands upright, as shown in FIG. 4, in which the projecting portion 52 is positioned below the ink supply port 69 and the direction in which the projecting portion 52 projects is parallel to the insertion direction. When the ink cartridge 10 inserted into the mounting space 90 is pressed in the insertion direction, the ink cartridge 10 slides on the bottom surface of the guide groove 92 formed in the bottom surface of the mounting case 9 and moves in the insertion direction. When this occurs, the lower end of the acting portion 87*a* of the lock lever 87 comes into contact with the upper surface of the ink cartridge 10 and is pressed upward.

While the ink cartridge 10 is moved in the mounting space 90 in the insertion direction, the distal end of the projecting portion 52 of the ink cartridge 10 in the insertion direction of projection comes into contact with the contact surface 841 of the slider 84 at the release position K2. If the ink cartridge 10 is pressed in the insertion direction further against the urging force of the urging member 85, the ink cartridge 10 and the slider 84 move together in the insertion direction, and the slider 84 reaches the mount position K1.

The ink supply tube 81 is inserted into the ink supply port 69 of the ink cartridge 10 while the slider 84 pressed by the ink cartridge 10 moves from the release position K2 to the mount position K1. The ink supply tube 81 inserted into the ink supply port 69 presses the valve body 64 inside the ink cartridge 10, and enters the second valve storage chamber 62. When this occurs, the seal member 66 is resiliently deformed and comes into tight contact with the outer peripheral surface of the ink supply tube 81. Accordingly, the interior of the second valve storage chamber 62 and the interior of the ink supply tube 81 communicate with each other and the ink in the interior of the ink chamber 51 can be supplied to the sub tank 15*b* via the ink supply tube 81 and the tube 22. Simultaneously, the valve body 74 of the air communication valve 71 of the ink cartridge 10 is pressed inward of the ink cartridge 10 by the valve operating pin 82 and hence the air communication port 79 is opened, such that the interior of the ink chamber 51 communicates with the atmospheric air and hence air is introduced to the interior of the ink chamber 51 to the extent corresponding to the amount of ink supplied to the exterior of the ink chamber 51.

Figure 11A:
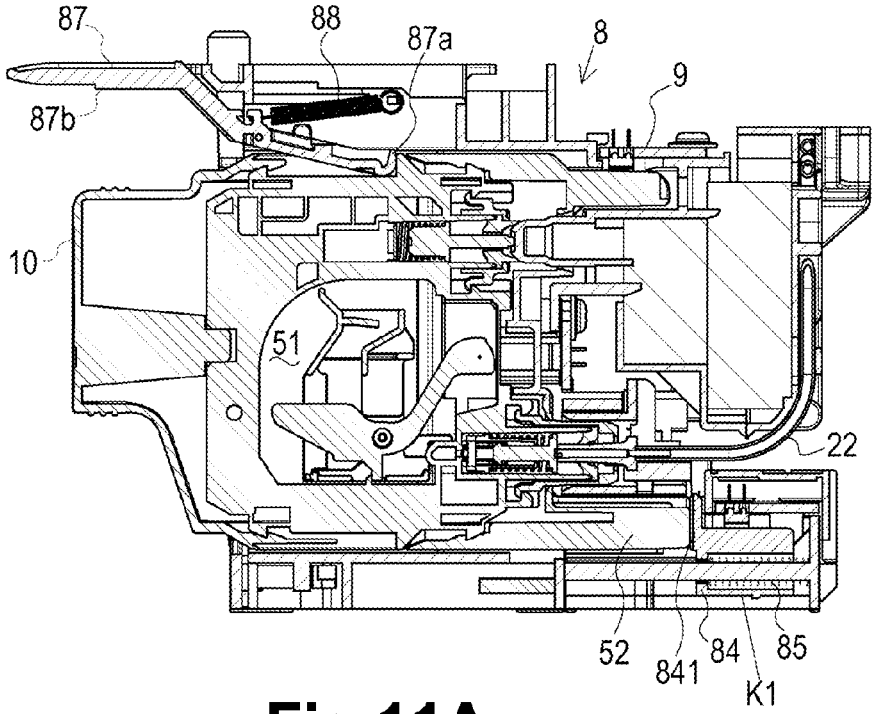
FIGS. 11A and 11B are vertical cross-sectional views of the liquid supply device taken along the insertion direction, in which the liquid cartridge is mounted in the mounting case in FIG. 11A and the liquid cartridge is released from the mounted state in FIG. 11B.

When the slider 84 is moved to the mount position K1, the acting portion 87*a* of the lock lever 87 fits into the locking groove 53 formed in the upper surface of the ink cartridge 10 contacting the slider 84. The acting portion 87*a* of the lock lever 87 fitted into the locking groove 53 comes into contact with a wall defining the locking groove 53, whereby the ink cartridge 10 is restricted from moving in the removal direction. In this manner, the movement of the ink cartridge 10 in the removal direction is restricted by the lock lever 87, and the movement of the ink cartridge 10 in the insertion direction is restricted by the pressing force from the slider 84, such that the ink cartridge 10 is retained in the mounting space 90 of the mounting case 9 of the mounting portion 99, as shown in FIG. 11A.

In contrast, when the ink cartridge 10 is intended to be removed from the mounting space 90, the operating portion 87*b* of the lock lever 87 is pressed downward, which causes the acting portion 87*a* of the lock lever 87 fitted in the locking groove 53 of the ink cartridge 10 to be moved upward. The acting portion 87*a* is thereby disengaged from the locking groove 53, such that the restriction of the movement of the ink cartridge 10 in the removal direction is released. Because the ink cartridge 10 is pressed by the slider 84 in the removal direction, if the restriction of the movement in the removal direction is released, the ink cartridge 10 starts to move in the removal direction.

Figure 11B:
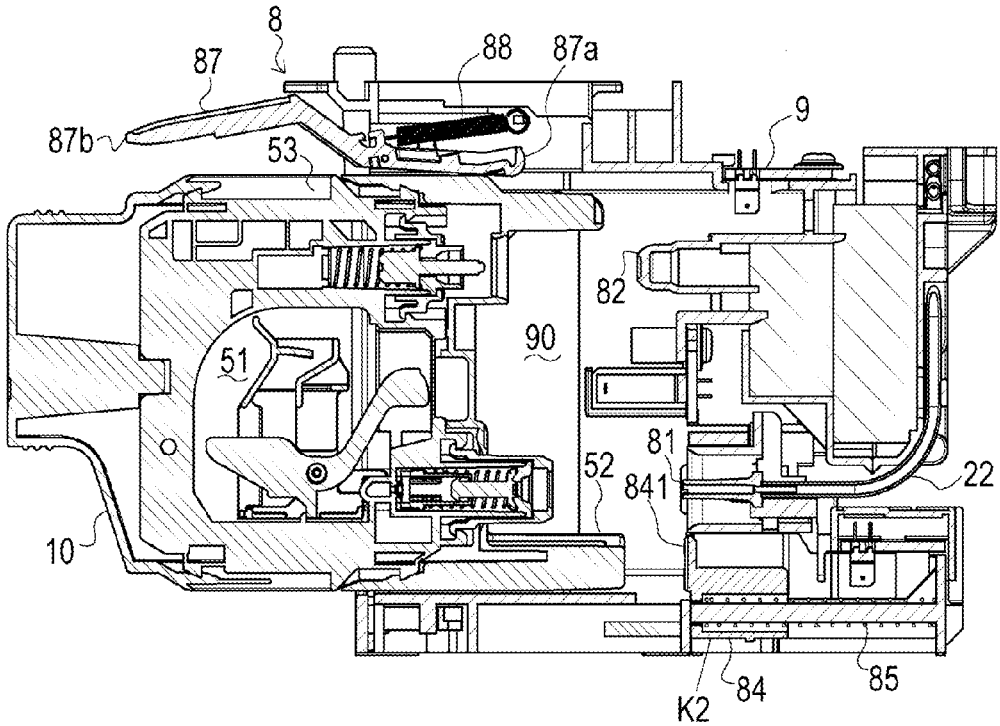

While the slider 84 moves from the mount position K1 to the release position K2, the slider 84 and the ink cartridge 10 contacting the slider 84 moves together in the removal direction. During this period, the ink supply tube 81 is separated from the valve body 64 of the ink supply valve 61, and hence the ink supply port 69 is closed, and that the ink supply tube 81 comes out of the ink supply port 69. Moreover, the valve operating pin 82 is separated from the valve body 74 of the air communication valve 71, and the air communication port 79 is closed. Then, as shown in FIG. 11B, when the slider 84 reaches the release position K2, the slider 84 stops moving in the removal direction. However, the ink cartridge 10 still continues to move in the removal direction away from the slider 84, and at least partially comes out of the mounting case 9. In this manner, when a user operates the lock lever 87, the ink cartridge 10 is automatically pushed out of the mounting case 9, and hence the user can readily perform the mounting and removing of the ink cartridge 10 without inserting his or her hand into the mounting case 9, which may make his or hand and making dirty with ink.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. A liquid cartridge urging unit for a mounting portion to which a liquid cartridge is configured to be mounted by being moved in a first direction, comprising:

a frame comprising:

two side portions extending in the first direction, wherein each of the two side portions comprises a first end in the first direction;

a connecting portion connecting the first ends of the two side portions; and at least one guide bar extending from the connecting portion in a second direction opposite to the first direction and positioned between the two side portions, such that the two side portions and the at least one guide bar are arranged in a third direction perpendicular to the first direction and the second direction;

two or more sliders, each of which is positioned between one of the two side portions and one of the at least one guide bar which is positioned adjacent to the one of the two side portions or between two of the at least one guide bar positioned adjacent to each other, wherein each of the two or more sliders is configured to contact the liquid container positioned in the mounting portion and configured to be guided by the at least one guide bar, such that each of the two or more sliders moves between a release position and a mount position, wherein the mount position is away from the release position in the first direction;

two or more urging members configured to urge the two or more sliders in the second direction, respectively; and at least one stopper disposed at the at least one guide bar and configured to contact the two or more sliders to restrict a movement of the two or more sliders in the second direction, such that the two or more sliders do not move beyond the release position, wherein each of the two or more sliders and the at least one guide bar comprises an engagement portion configured to restrict movements of one of the two or more sliders and a corresponding one of the at least one guide bar separating from each other in the third direction, and wherein the engagement portion of the slider comprises a first lip extending in a fourth direction perpendicular to the first direction, the second direction, and the third direction, and the engagement portion of the guide bar comprises a second lip extending in a fifth direction opposite to the fourth direction, where the first lip and the second lip are overlapped in the third direction.

2. The liquid cartridge urging unit of claim 1, wherein each of the at least one guide bar comprises one of the at least one stopper and each of the at least one stopper is configured to contact two of the two or more sliders positioned on both sides of the each of the at least one stopper.

3. The liquid cartridge urging unit of claim 1, wherein each of the two or more urging members is positioned between the connecting portion and one of the two or more sliders, and between two of the at least one guide bar positioned on both sides of the one of the two or more sliders or between one of the two side portions and one of the at least one guide bar positioned on both sides of the one of the two or more sliders.

4. The liquid cartridge urging unit of claim 1, wherein the frame further comprises two or more rail bars corresponding to the two or more sliders and extending from the connecting portion in the second direction, wherein each of the two or more urging members comprises a coil spring, and each of the two or more rail bars is inserted through the coil spring of a corresponding one of the two or more urging members.

5. The liquid cartridge urging unit of claim 1, wherein each of the two side portions comprises a extended portion extending in the second direction beyond the two or more sliders positioned at the release position, and the extended portion comprising an attachment portion configured to be attached to a portion of the mounting portion.

6. The liquid cartridge urging unit of claim 1, wherein the movements of one of the two or more sliders and a corresponding one of the at least one guide bar separating from each other in the third direction is restricted by mutual engagement of the first lip and the second lip.

7. The liquid cartridge urging unit of claim 1, wherein each of the two or more sliders comprises a guide groove formed therein, and a portion of a corresponding one of the at least one guide bar is fitted into the guide groove, such that the second lip of the corresponding one of the at least one guide bar is positioned inside the guide groove beyond the first lip.

8. The liquid cartridge urging unit of claim 7, wherein the guide groove is defined by a vertical surface extending in the fourth direction and the fifth direction, an upper surface extending toward the corresponding one of the at least one guide bar from an upper end of the vertical surface, and a lower surface extending toward the corresponding one of the at least one guide bar from a lower end of the vertical surface, wherein the first lip extends from the upper surface at an end of the upper surface adjacent to the corresponding one of the at least one guide bar.

9. The liquid cartridge urging unit of claim 1, wherein each of the two or more sliders comprises a protruding portion, and the at least one stopper is configured to contact the protruding portion of the slider.

10. The liquid cartridge urging unit of claim 9, wherein each of the two or more sliders comprises a slit formed therein, and the slit extends in the second direction and is positioned closer to a center of the slider than the protruding portion in the third direction.

11. A liquid cartridge urging unit for a mounting portion to which a liquid cartridge is configured to be mounted by being moved in a first direction, comprising:

a frame comprising:

two side portions extending in the first direction, wherein each of the two side portions comprises a first end in the first direction;

a connecting portion connecting the first ends of the two side portions; and at least one guide bar extending from the connecting portion in a second direction opposite to the first direction and positioned between the two side portions, such that the two side portions and the at least one guide bar are arranged in a third direction perpendicular to the first direction and the second direction;

two or more sliders, each of which is positioned between one of the two side portions and one of the at least one guide bar which is positioned adjacent to the one of the two side portions or between two of the at least one guide bar positioned adjacent to each other, wherein each of the two or more sliders is configured to contact the liquid container positioned in the mounting portion and configured to be guided by the at least one guide bar, such that each of the two or more sliders moves between a release position and a mount position, wherein the mount position is away from the release position in the first direction;

two or more urging members configured to urge the two or more sliders in the second direction, respectively; and at least one stopper disposed at the at least one guide bar and configured to contact the two or more sliders to restrict a movement of the two or more sliders in the second direction, such that the two or more sliders do not move beyond the release position, wherein each of the two or more sliders and the at least one guide bar comprises an engagement portion configured to restrict movements of one of the two or more sliders and a corresponding one of the at least one guide bar separating from each other in the third direction, wherein each of the two or more sliders comprises a protruding portion, and the at least one stopper is configured to contact the protruding portion of the slider, and wherein each of the two or more sliders comprises a slit formed therein, and the slit extends in the second direction and is positioned closer to a center of the slider than the protruding portion in the third direction.

* * * * *